United States Patent [19]

Malmros

[11] 4,012,994

[45] Mar. 22, 1977

[54] AXIAL BEARING DEVICE FOR THE CYLINDER BARREL IN AN AXIAL PISTON MACHINE

[75] Inventor: Sten Axel Torby Malmros, Trollhattan, Sweden

[73] Assignee: Volvo Flygmotor Aktiebolag, Trollhattan, Sweden

[22] Filed: May 5, 1975

[21] Appl. No.: 574,668

[52] U.S. Cl. ..... 91/499; 92/57

[51] Int. Cl.[2] ..... F01B 3/00; F01B 13/04

[58] Field of Search ..... 92/130 B, 57; 91/499, 91/500

[56] References Cited

UNITED STATES PATENTS

| | | | |
|---|---|---|---|
| 1,203,165 | 10/1916 | Williams et al. | 91/499 |
| 2,040,390 | 5/1936 | Loe | 91/499 |
| 2,990,784 | 7/1961 | Wahlmork | 91/499 |
| 3,410,220 | 11/1968 | Krotzenberg et al. | 91/499 |

FOREIGN PATENTS OR APPLICATIONS

| | | | |
|---|---|---|---|
| 671,321 | 10/1963 | Canada | 91/499 |
| 1,653,461 | 7/1971 | Germany | 91/499 |
| 348,322 | 8/1960 | Switzerland | 91/499 |

*Primary Examiner*—Paul E. Maslousky
*Attorney, Agent, or Firm*—Pollock, Vande Sande & Priddy

[57] ABSTRACT

An axial bearing device is provided for the cylinder barrel in an axial piston machine, particularly of so-called bent-axis type, i.e. with the axis of the barrel inclined to the axis of the drive disk. The barrel is rotatably journalled in a housing, which is open at one end, and adapted to be resiliently urged by means of a spring member against a valve disk at the other end of said housing, which is closed. The spring member comprises an elongated leaf spring which at one end is fixed at a position on the inside of the housing and at the other engages a bearing ring located in a raceway radially outwardly of the mouths of the cylinder bores at the end of the cylinder barrel remote from said valve disk.

3 Claims, 4 Drawing Figures

AXIAL BEARING DEVICE FOR THE CYLINDER BARREL IN AN AXIAL PISTON MACHINE

BACKGROUND OF THE INVENTION

The present invention refers to an axial bearing device for the cylinder barrel in an axial piston machine, particularly of so-called bent-axis-type, i.e. with the axis of the barrel inclined to the axis of the drive disk, said barrel being rotatably journalled in a housing, which is open at one end, and adapted to be resiliently urged by means of a spring member against a valve disk at the other end of said housing, which is closed.

In prior axial piston machines, the cylinder barrel mostly is journalled either by means of a central bearing unit and biasing springs or some kind of annular locking washer around the external surface of the cylinder barrel at its end adjacent the valve disc.

The first-mentioned kind of bearing known, e.g. from the U.S. Pat. No. 2,858,771 has the disadvantage that the central bearing unit requires great space, particularly in the radial direction and therefore the cylinder barrel is required to have an excessive diameter or a relatively greater number of axial pistons is required for the same displacement.

The expedient of providing the bearing by means of an annular locking washer around the outer periphery of the cylinder barrel is disclosed in the Swedish Lay-Open Print 302,889. This kind of bearing is relatively simple to manufacture but elongates the barrel and thus the machine to some extent and thus causes longer inlet paths to the cylinder bores for the axial pistons in the cylinder barrel. A bearing device of similar kind in principle is also known from the French patent specification 1,235,100. From the French patent specification 714,963 it is also known to provide a similar biasing action by a cup or "Belleville" spring in a machine which is of radial piston type, in which however, the same difficulties are not met in this respect as in machines of the axial piston type.

SUMMARY OF THE INVENTION

The object of the present invention is to provide an axial bearing device of the kind stated, in which the above-mentioned disadvantages are eliminated without requiring increased dimensions of the barrel than is necessary from the functional view-point. The invention is based on the idea that a position is to be chosen for the bearing which is independent of or unimportant to, the operation.

This is achieved by means of a bearing device substantially distinguished in that said spring member comprises an elongated leaf spring which at one end is fixed at a position on the inside of the housing and at its other end engages a bearing ring located in a raceway radially outwardly of the mouths of the cylinder bores at the end of the cylinder barrel remote from said valve disk.

Because of the bearing device according to the invention it now becomes possible to apply the axial biasing force at a position which does not affect the function and dimensioning of the cylinder barrel. The machine thus can be designed with a lower number of axial pistons in an optimum pitch of the location of the cylinder bores than would be required when using, for example, a voluminous central axial bearing. Thus the diameter of the cylinder barrel can be kept small with the consequence that the machine can operate at high speeds.

Another advantage is that the bearing device has a small radial dimension also when moderate surface pressures are required, since the axial biasing force is applied over a surface coaxial with the cylinder barrel and located radially beyond the cylinder bores and therefore the bearing device does not require greater radial space than the cylinder barrel itself.

Still another advantage of the bearing device according to the present invention over the prior art is that it has no influence whatsoever on the length of the barrel, which therefore can be short so as to provide better priming of the machine when it operates as a pump.

Furthermore, the bearing device also allows a reduction of the dimensions of the housing in comparison with the second stated main kind of bearing having a peripheral locking washer. The parts included in the bearing device according to the present invention and the measures in connection therewith are, moreover, simple, inexpensive and reliable and particularly well-suited for modern mass-producton.

BRIEF DESCRIPTION OF THE DRAWINGS

By way of example, the invention will be further disclosed below with reference to the accompanying drawings, in which.

DETAILED DESCRIPTION OF THE PREFERRED EMBODIMENT

Figure 1:
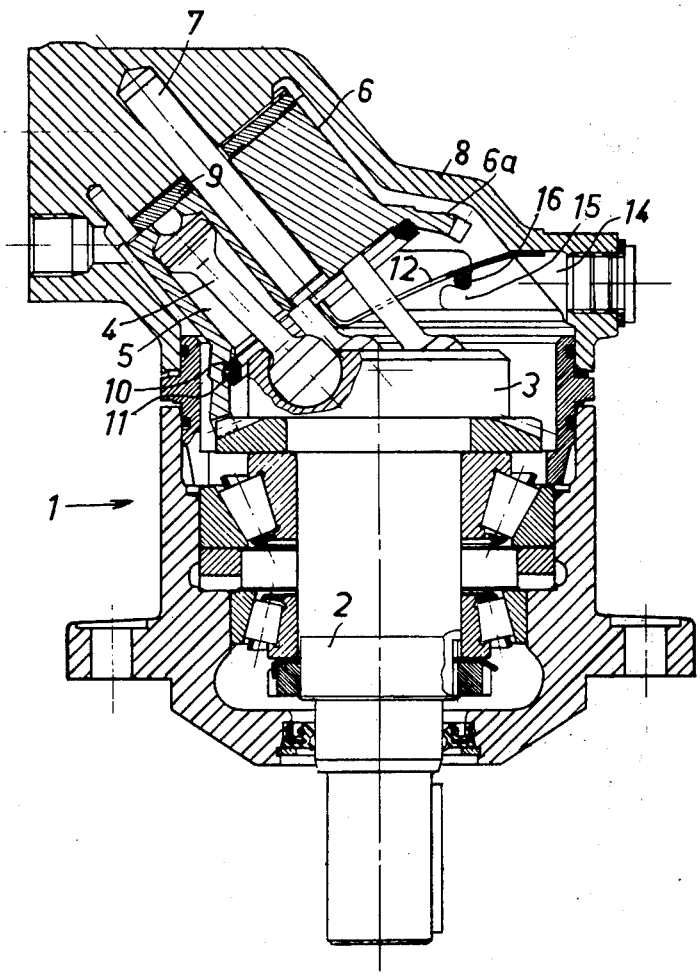
FIG. 1 is a side elevational view in cross-section of an axial piston machine with an embodiment of the inventive bearing device.

With reference to the drawings, FIG. 1 illustrates an axial piston machine 1 of so-called bent-axis type and comprising a shaft 2, journalled in a bearing housing and supporting a drive disk 3 which as known per se is provided with a number of bearing cups for accommodation of the partially ball-shaped bearing ends of a number of axial pistons 4, such as five pistons.

Said pistons 4 are movable in corresponding cylinder bores 5 in a cylinder barrel 6 which is inclined to the shaft 2 and rotationally synchronized with the drive disk 3 and which is rotatably journalled on a central bearing pin 7 in a housing 8, open at one end, said barrel furthermore being kept resiliently biased against a valve disk 9 at the opposite end of the housing 8, which is closed.

To provide an axial bearing for the barrel 6, an annular raceway 10 is provided at its end remote from the valve disk 9, said raceway being located radially beyond the mouths of the cylinder bores 5 of the barrel. Said raceway 10 is adapted to accommodate a bearing ring 11 having a corresponding cross-sectional shape and made of suitable material, preferably steel and most preferably sintered steel.

Figure 2:
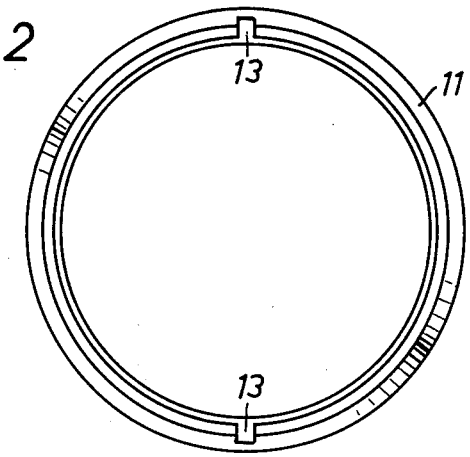
FIG. 2 is a plan view to an enlarged scale of a bearing ring of the inventive bearing device.
Figure 3B:
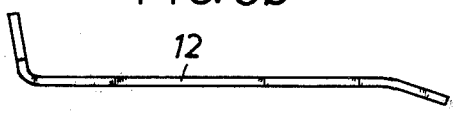
FIGS. 3*a* and 3*b* comprise plan and side elevational views, respectively, of an enlarged scale of a leaf spring of the inventive bearing device.
Figure 3A:
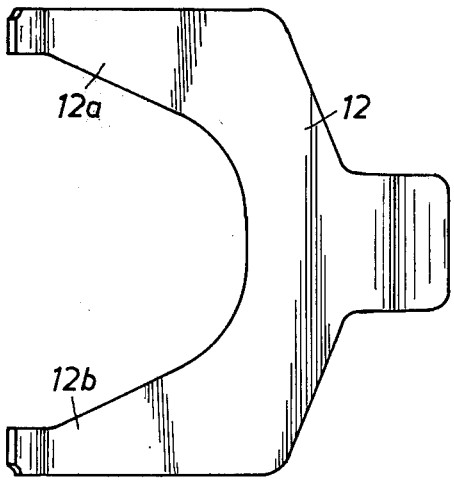

To provide the required axial biasing force on the barrel 6, a leaf spring 12 mounted in the housing 8 acts on said bearing ring 11. Although said leaf spring naturally can be shaped in a number of ways, it is shaped in the present case, such as is particularly evident from FIGS. 3*a* and 3*b* of the drawings, at one end so as to permit its being fixed in the housing and at the other free end so as to have two fork-like parallel limbs 12*a*, 12*b*. The ends of said limbs 12*a*, 12*b* are adapted to act with a desired and calibrated spring force against the bearing ring 11 and, through this bias, the barrel as desired is axially urged against the valve disk 9. In order to simultaneously prevent the bearing ring 11 from being entrained in the rotational movement of the barrel, the ends of the limbs 12*a*, 12*b* are preferably made so as to engage corresponding and diametrically located notches 13 in the bearing ring 11 (see FIG. 2).

The raceway 10 in the barrel 6 can have any suitable form and has been illustrated in the drawings as comprising an annular porton located in a radial plane with an outwardly adjoining, cylindrical annular surface. It is only required that a sufficient radial surface be presented for obtaining suitable surface pressures in the axial bearing while the outer cylindrical annular surface preferably is adapted to provide the required radial guiding of the bearing ring 11. Of course, also other cross-sectional shapes can be selected, however, for this raceway when desired.

The mounting of the leaf spring 12 in the housing 8 of the axial piston machine 1 can be provided in several different ways, but in the present case it has been illustrated as being provided by means of a recess 14 on the inner surface of the wall of the housing 8, against the bottom of which the end of the leaf spring 12 is adapted to abut. At a position in the housing 8 with determined spacing from the recess 14 there is furthermore an abutment or seat 15 for localizing a removable support pin 16 for the spring mounting. Said support pin 16 preferably constitutes a cylindrical pin of, e.g., steel and extends transversely to the leaf spring 12. The mounting of the leaf spring 12 between the bottom of a recess 14 and the peripheral surface of an interchangeable cylindrical support pin 16 gives the great advantage that one and the same type of leaf spring 12 easily can be brought to apply biasing forces of various magnitude against the barrel 6 through the bearing ring 11 and the raceway 10 by selection of different diameters of the cylindrical support pin 16 located in the abutment 15. By a suitable design of the abutment 14 on the inner surface of the wall of the housing 8 and adjacent wall portions, the spring can be longitudinally localized in a simple manner.

The greatest advantage of the axial bearing device according to the present invention is that, owing to its design, it can be disposed at a position which almost is a "dead" space, i.e. a place on the cylinder barrel 6 which is almost without importance from the operational and dimensioning-view point. The transition area between the cylinder barrel 6 and the bevel tooth ring 6*a* belonging to the synchronization transmission of the drive disk 3 is namely just such a place which has not been utilized hitherto. By now disposing the raceway with the bearing ring accommodated therein at this place, there is no interference either on the radial nor the axial dimensioning demands for the barrel and for the rest a bearing is obtained which is very simple, inexpensive in manufacture and reliable.

The bearing device according to the invention also permits simplified manufacture of the cylinder barrel, having the tooth ring 6*a* made as a separate part, which is angularly secured by means of a number of axial guide pins at the end of the barrel and for the rest secured thereto by means of the biasing force of the bearing device.

I claim:

1. An axial piston pump of the bent-axis type comprising:

a rotatable shaft, a drive disk, at least one piston having a ball-shaped end supported on said disk and axially movable in a cylindrical bore formed in a cylinder barrel which is inclined relative to the axis of said shaft and which rotates synchroniously with said shaft, said cylinder barrel being rotationally journalled in a housing which is open at a first end thereof adjacent to said drive disk, a raceway at an end of said cylinder barrel which is adjacent said first end of said housing, said raceway being radially outwardly of said cylindrical bores in said barrel for receiving a bearing ring, means for resiliently urging said cylinder barrel against a valve disk at the other end of said housing, said urging means comprising an elongated leaf spring whose one end is fixed at a predetermined position on the interior of said housing and whose other end engages said bearing ring.

2. The apparatus of claim 1, wherein said leaf spring at its said other end is formed like a yoke with two substantially parallel limbs which engage corresponding notches diametrically opposed on said bearing ring.

3. The apparatus of claim 2, in which said leaf spring is mounted with its said one end being supported in said housing on a support means, and a support pin located in an abutment in said housing and abutting said spring at a location intermediate its ends, said support pin being removable and replaceable for allowing a change of the curvature of said spring and thus its biasing force by appropriate selection of the diameter of said support pin.

* * * * *

UNITED STATES PATENT AND TRADEMARK OFFICE

CERTIFICATE OF CORRECTION

PATENT NO. : 4,012,994

DATED : March 22, 1977

INVENTOR(S) : STEN AXEL TORBY MALMROS

It is certified that error appears in the above-identified patent and that said Letters Patent are hereby corrected as shown below:

Foreign Application Priority Data

May 13, 1974 Sweden. . . . . 74 06378

Signed and Sealed this

*Eleventh* Day of *October 1977*

[SEAL]

*Attest:*

RUTH C. MASON
*Attesting Officer*

LUTRELLE F. PARKER
*Acting Commissioner of Patents and Trademarks*